US007175551B1

(12) United States Patent
Hamilton

(10) Patent No.: US 7,175,551 B1
(45) Date of Patent: Feb. 13, 2007

(54) REMOVABLE BASKETBALL RIM ASSEMBLY

(76) Inventor: Scott Hamilton, P.O. Box 2375, Northlake, IL (US) 60164

( * ) Notice: Subject to any disclaimer, the term of this patent is extended or adjusted under 35 U.S.C. 154(b) by 211 days.

(21) Appl. No.: 10/994,585

(22) Filed: Nov. 22, 2004

(51) Int. Cl.
*A63B 63/08* (2006.01)

(52) U.S. Cl. ..... 473/486

(58) Field of Classification Search ..... 473/481, 473/482, 483, 484, 486, 485
See application file for complete search history.

(56) References Cited

U.S. PATENT DOCUMENTS

| | | | | | |
|---|---|---|---|---|---|
| D101,090 | S | | 9/1936 | Sandberg | |
| 5,066,007 | A | * | 11/1991 | Niver | 473/486 |
| 5,106,084 | A | * | 4/1992 | Vaught | 473/486 |
| 5,433,095 | A | | 7/1995 | Mitchell et al. | |
| 5,439,210 | A | | 8/1995 | Davis | |
| 5,480,139 | A | * | 1/1996 | Owen et al. | 473/486 |
| 5,582,401 | A | | 12/1996 | Malone et al. | |
| 5,628,507 | A | | 5/1997 | Johnson | |
| 5,816,955 | A | * | 10/1998 | Nordgran et al. | 473/486 |
| 5,823,897 | A | | 10/1998 | Wang | |
| 5,881,583 | A | | 3/1999 | Booker et al. | |
| 6,186,911 | B1 | * | 2/2001 | Manthey | 473/486 |
| 6,296,583 | B1 | * | 10/2001 | Tatar, Sr. | 473/486 |
| 6,935,972 | B2 | * | 8/2005 | Hehr | 473/486 |
| 2003/0054906 | A1 | * | 3/2003 | Allshouse et al. | 473/486 |

* cited by examiner

*Primary Examiner*—Eugene Kim
*Assistant Examiner*—M. Chambers

(57) ABSTRACT

A removable basketball assembly includes a housing section securely mounted to a selected portion of the backboard and an anchor section removably positionable into the housing. A rim section is pivotally connected to the anchor section and extends outwardly therefrom. A mechanism for locking the anchor section with the housing section after the anchor section has been positioned therein is also included. The assembly further includes a mechanism for resiliently opposing downwardly forces exerted on the rim section such that a player can offset the rim section from the horizontal plane without permanently detaching the rim section from the anchor section. The housing section includes a rear wall provided with a plurality of holes for receiving a plurality of fastening members therethrough respectively. A protruding support compartment is integral with the rear wall and has a plurality of sidewalls and a front wall integrally connected for defining a cavity therebetween.

12 Claims, 8 Drawing Sheets

REMOVABLE BASKETBALL RIM ASSEMBLY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to basketball rims and, more particularly, to a removable basketball rim assembly.

2. Prior Art

Basketball hoops or rims have long been used for indoor and outdoor sporting enjoyment. They are used in a variety of settings, from public parks to private residential driveways. Typically, a basketball rim is mounted to a backboard, which is in turn mounted on a pole, hung from a ceiling, or mounted to a structure such as a garage.

However, basketball rims suffer from the disadvantage that they cannot easily be removed from their mountings when it is desired to prohibit their use. For example, the owner of a basketball rim mounted on a residential garage may wish to prohibit use of the rim at night, when the noise of the basketball hitting the backboard or ground disrupts the sleep of the owner. To prohibit use of the rim, the owner must physically remove the rim from the garage. Obviously, physical removal of the rim each night and replacement each day is time-consuming and inefficient.

In the case of a basketball rim that is mounted on a backboard hung from a ceiling, it is possible to prohibit use of the rim by providing the assembly with a mechanism to raise the rim and attached backboard to the ceiling, thereby prohibiting use of the rim. However, such mechanisms are expensive and potentially dangerous.

Accordingly, a need remains for removable basketball rim assembly that enables a user to quickly and easily remove the rim from the backboard. The present invention satisfies such a need by providing a rim or hoop assembly that requires no tools for installation or removal, thus saving owners time and money. Such a rim assembly further reduces the risk of falling from a ladder during installation and removal because a user would not be handling tools while performing the installation/removal.

BRIEF SUMMARY OF THE INVENTION

In view of the foregoing background, it is therefore an object of the present invention to provide a removable basketball rim assembly. These and other objects, features, and advantages of the invention are provided by a basketball rim assembly for allowing a player to removably attach a rim to an existing backboard. Such an assembly includes a housing section securely mounted to a selected portion of the backboard and having a centrally disposed vertical axis and an anchor section removably positionable into the housing.

The assembly further includes a rim section pivotally connected to the anchor section and extending outwardly therefrom along a substantially horizontal plane. A mechanism for locking the anchor section with the housing section after the anchor section has been positioned therein is also included. The assembly further includes a mechanism for resiliently opposing downwardly forces exerted on the rim section such that a player can offset the rim section from the horizontal plane without permanently detaching the rim section from the anchor section.

The housing section preferably includes a substantially planar rear wall provided with a plurality of holes formed at opposed corners thereof for receiving a plurality of fastening members therethrough respectively. A protruding support compartment is integral with the rear wall and has a plurality of sidewalls and a front wall integrally connected for defining a cavity therebetween.

The anchor section preferably includes a plurality of walls integrally attached for defining a generally rectangular shape corresponding to a shape of the cavity. Opposing ones of the walls are provided with a plurality of slots extending parallel to each other. Selected ones of the slots are oppositely spaced apart and positioned along a level plane.

The anchor section preferably further includes a pair of spaced flange portions protruding forwardly from one of the walls and equidistantly spaced from the axis. A cover plate may be positioned over an open top end of the anchor section and pivotally connected to the rim section respectively.

The rim section preferably includes a mounting bracket having a rear wall engageable with the opposing mechanism and further having a top wall extending forwardly therefrom. The top wall has a plurality of integrally positioned finger portions extending downwardly and rearwardly therefrom and at an angle offset from the axis. The rim section preferably further includes a substantially annular rim rigidly secured to the mounting bracket and engaged with the finger portions wherein the rim is positioned forwardly of the mounting bracket rear wall.

The locking mechanism preferably includes a plurality of levers and a key lock operably connected thereto. The levers are selectively positionable between lateral and medial positions when a player inserts a key into the lock and rotates the lock along counter clockwise and clockwise positions respectively. The levers preferably include a lower wall adaptable between offset and linear positions corresponding to the medial and lateral positions respectively. The levers may further include a plurality of vertically oriented sidewalls each provided with a plurality of stacked appendages extending laterally therefrom.

The locking mechanism preferably further includes a plurality of ball bearings and a plurality of spring members operably attached thereto and to the lever sidewalls wherein the bearings are juxtaposed between the appendages respectively. The levers are removably positioned into the anchor section wherein the appendages become interlocked with the slots of the anchor section. The levers are removable from the anchor section when the player adapts the levers to the medial position and disengages the appendages from the slots respectively.

The housing section preferably further has a plurality of horizontal slots formed therein for selectively receiving the appendages during operating conditions and a plurality of vertical slots for selectively receiving the flange portions of the anchor section and assisting to maintain the anchor section at a substantially stable position. A central slot is preferably formed therein.

The anchor section preferably further includes a horizontally disposed elongated bar protruding forwardly therefrom and including a control switch operably connected thereto wherein the bar is selectively adaptable between retracted and extended positions for disengaging and engaging the central slot. The rim section may be provided with a cut out portion sized and shaped for assisting a player to maintain an elevated position while engaging the switch and removing the anchor section from the housing section.

The opposing mechanism preferably includes a plurality of spring members. One of the spring members has opposed end portions secured to the anchor section and operably mateable with the rim section rear wall. The one spring member is compressible along the horizontal plane when the rim is downwardly pivoted during playing conditions.

Other ones of the spring members preferably have opposed end portions secured to the mounting bracket rear wall and the finger portions respectively and cooperate with the one spring member for resisting a downward movement of the rim. In an alternate embodiment, a plurality of rigid arms are secured to the mounting bracket and positioned adjacent the rim for resisting external forces acting on the rim section during playing conditions.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
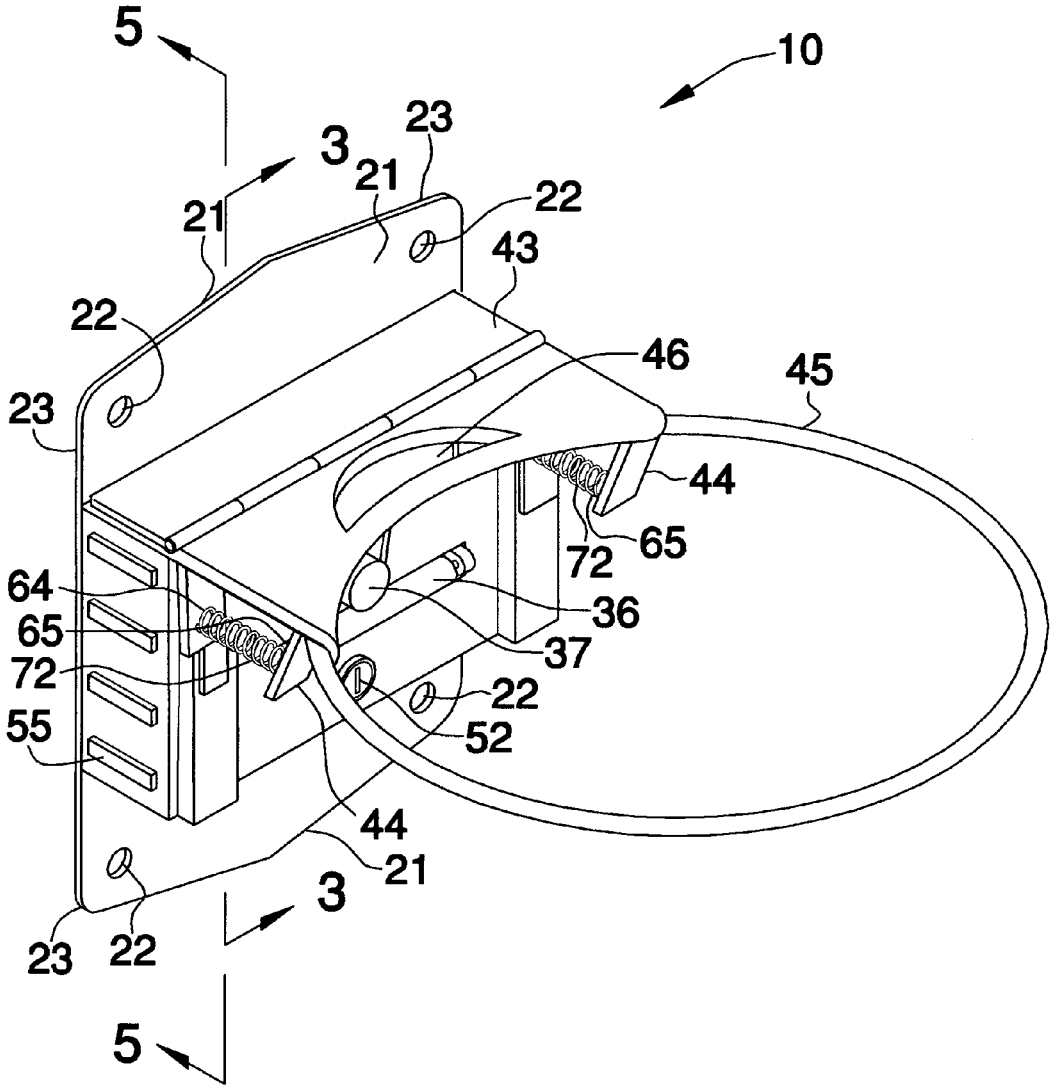
FIG. 1 is a perspective view showing a removable basketball rim assembly, in accordance with the present invention.

The present invention will now be described more fully hereinafter with reference to the accompanying drawings, in which preferred embodiments of the invention are shown. This invention may, however, be embodied in many different forms and should not be construed as limited to the embodiment set forth herein. Rather, these embodiments are provided so that this application will be thorough and complete, and will fully convey the true scope of the invention to those skilled in the art. Like numbers refer to like elements throughout the figures and prime and double prime numbers refer to like elements of alternate embodiments.

The apparatus of this invention is referred to generally in FIGS. 1–9 by the reference numeral 10 and is intended to provide a removable basketball rim assembly. It should be understood that the assembly 10 may be used to attach and remove a basketball rim to many different types of backboards in many different places and should not be limited to only playground or outdoor backboards found at schools and other municipal locations.

Figure 2:
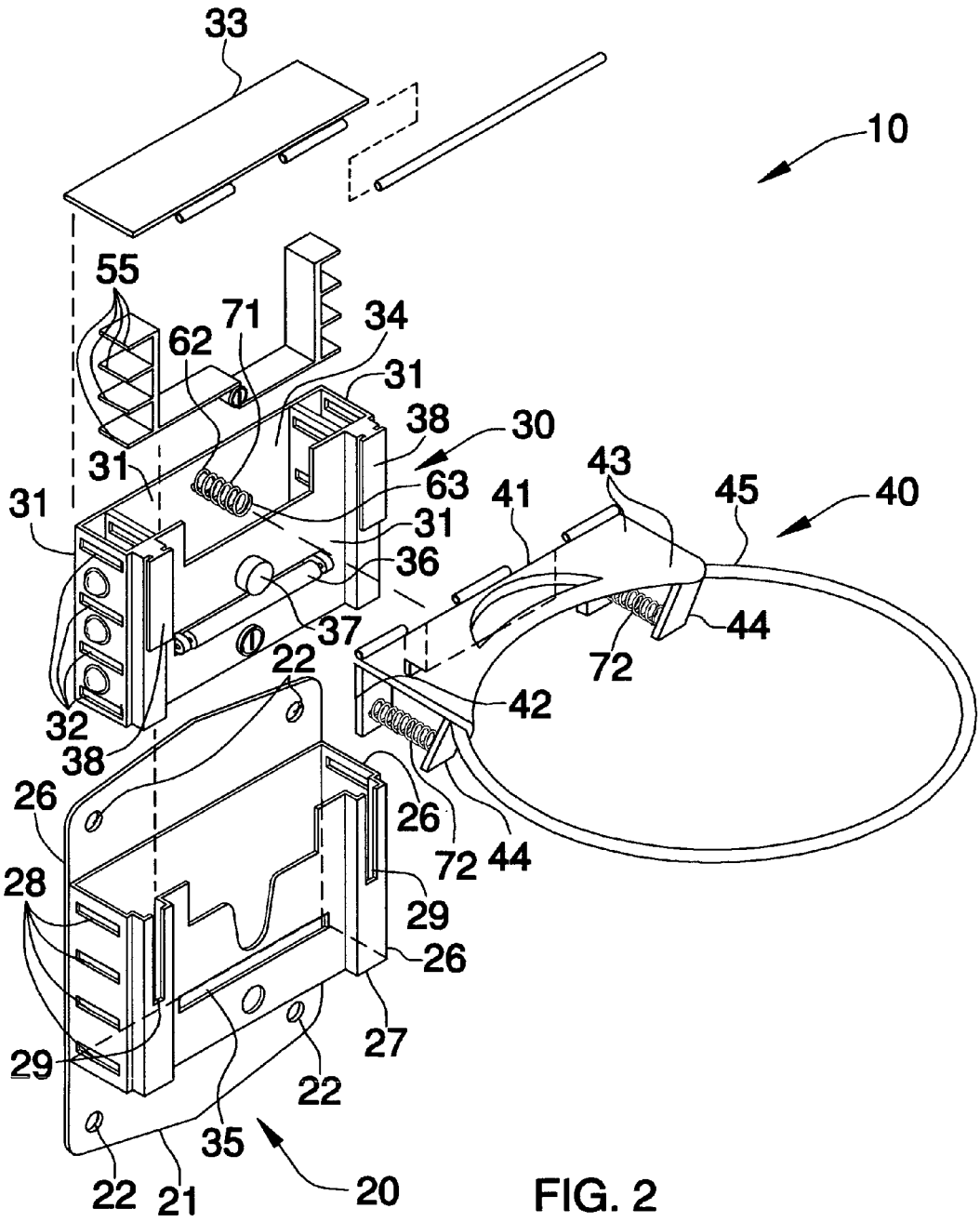
FIG. 2 is an exploded view of the present invention shown in FIG. 1.

Referring to FIGS. 1 and 2, the assembly 10 includes a housing section 20 securely mounted to a selected portion of the backboard and having a centrally disposed vertical axis (not shown) and an anchor section 30 removably positionable into the housing 20.

Still referring to FIGS. 1 and 2, the assembly 10 further includes a rim section 40 pivotally connected to the anchor section 30 and extending outwardly therefrom along a substantially horizontal plane. A mechanism 50 for locking the anchor section 30 with the housing section 20 after the anchor section 30 has been positioned therein is also included. The assembly 10 further includes a mechanism 60 for resiliently opposing downwardly forces exerted on the rim section 40 such that a player can offset the rim section 40 from the horizontal plane without permanently detaching the rim section 40 from the anchor section 30. Such a feature allows players to hang on the rim after dunking, as is commonly done, to avoid injury that might occur by landing on another player. Advantageously, the opposing mechanism 60 allows the rim 45 to pivot downwardly without damaging or permanently detaching the rim 45 from the backboard.

Figure 8:
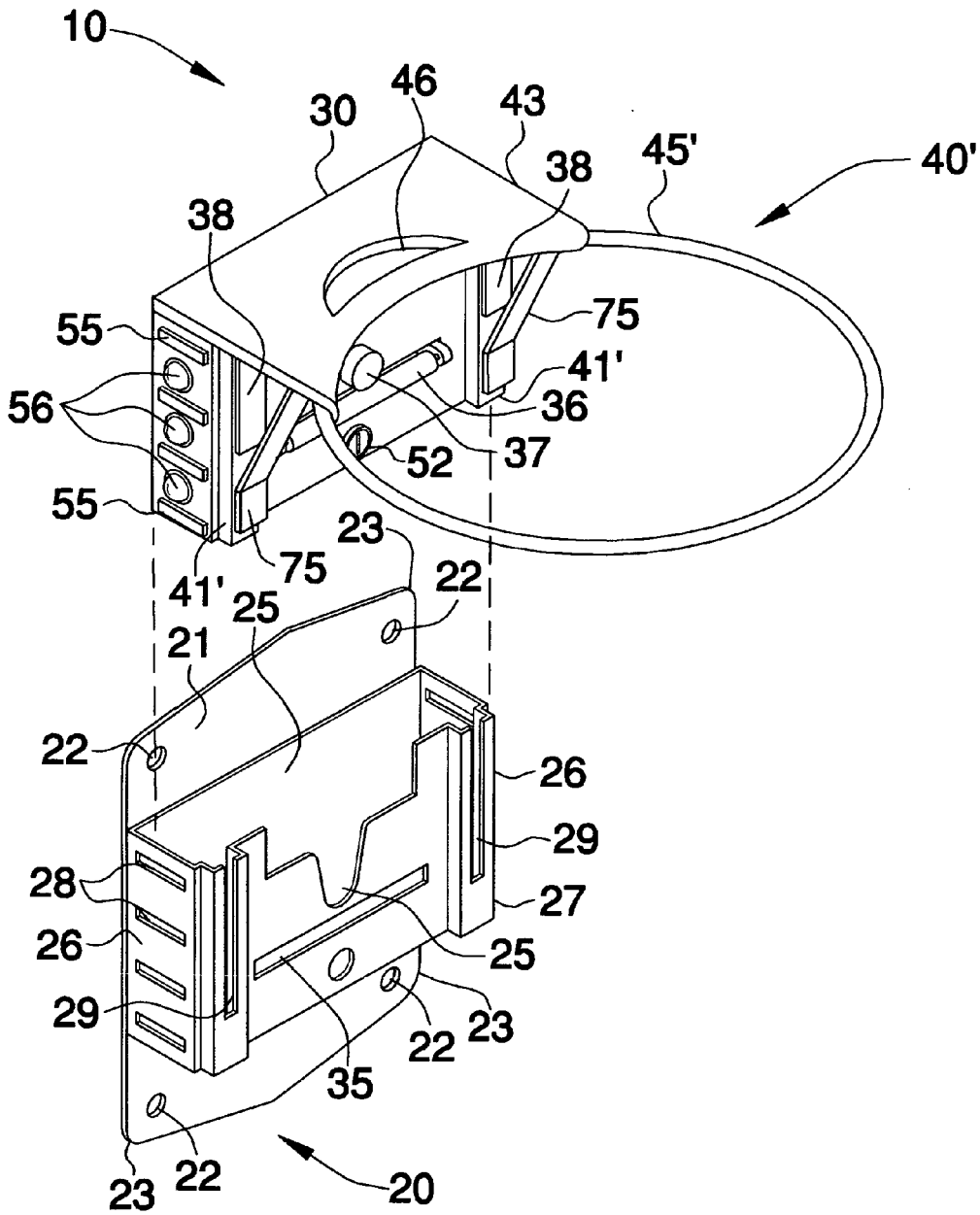
FIG. 8 is a perspective view of the housing section receiving the anchor section and an alternate embodiment of the opposing mechanism.

Referring to FIG. 8, the housing section 20 preferably includes a substantially planar rear wall 21 provided with a plurality of holes 22 formed at opposed corners 23 thereof for receiving a plurality of fastening members such as conventional nuts and bolts well known in the industry (not shown) therethrough respectively. A protruding support compartment 25 is integral with the rear wall 21 and has a plurality of sidewalls 26 and a front wall 27 integrally connected for defining a cavity therebetween. Such a cavity is for receiving the anchor section 30 having a corresponding shape so that there is little or no vibration when a basketball hits the rim 45.

Referring to FIGS. 2 and 8, the anchor section 30 preferably includes a plurality of walls 31 integrally attached for defining a generally rectangular shape corresponding to a shape of the cavity. Opposing ones of the walls 31 are provided with a plurality of slots 32 extending parallel to each other. Selected ones of the slots 32 are oppositely spaced apart and positioned along a level plane.

Figure 7:
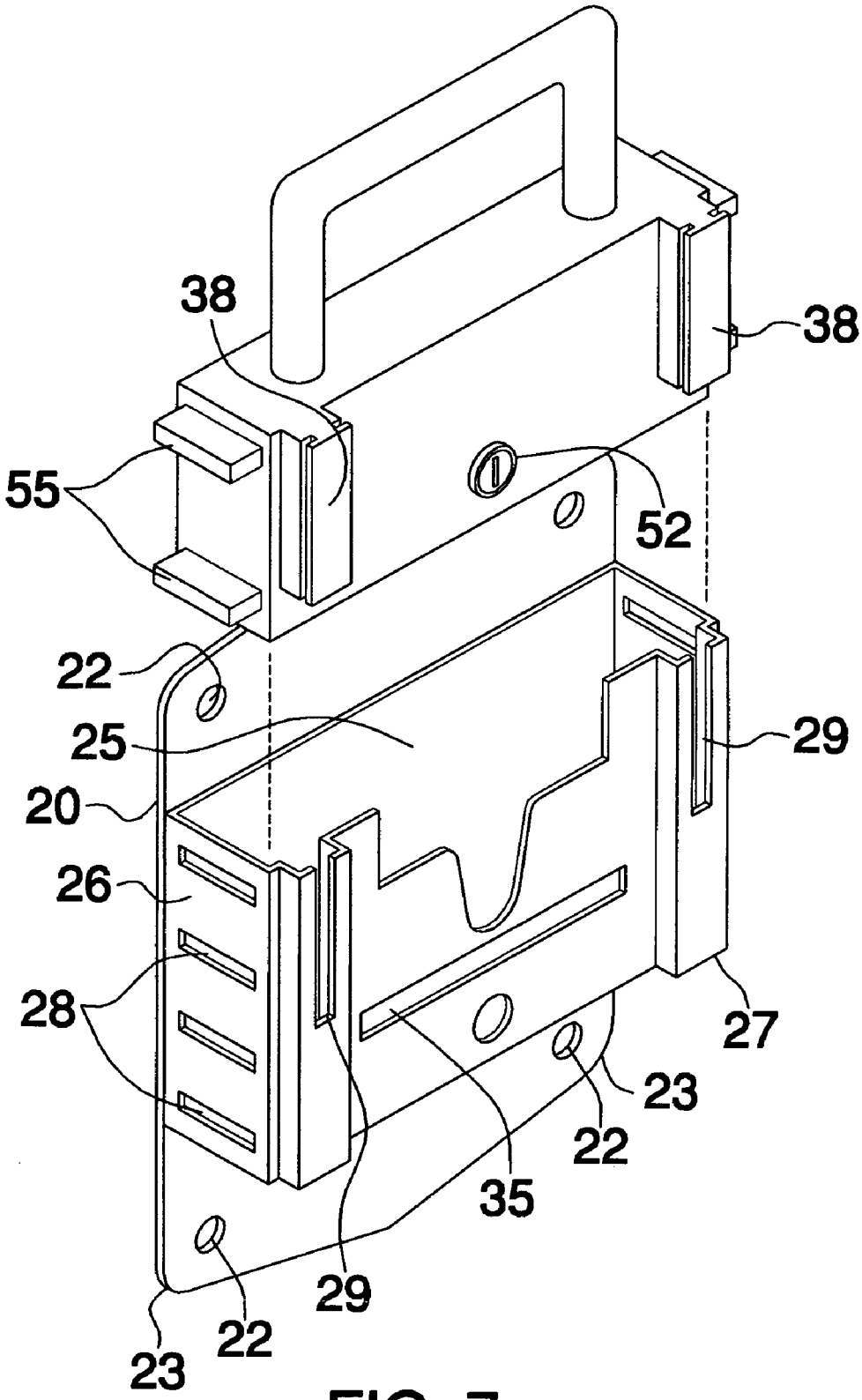
FIG. 7 is a perspective view of the housing section receiving the anchor section.
Figure 9:
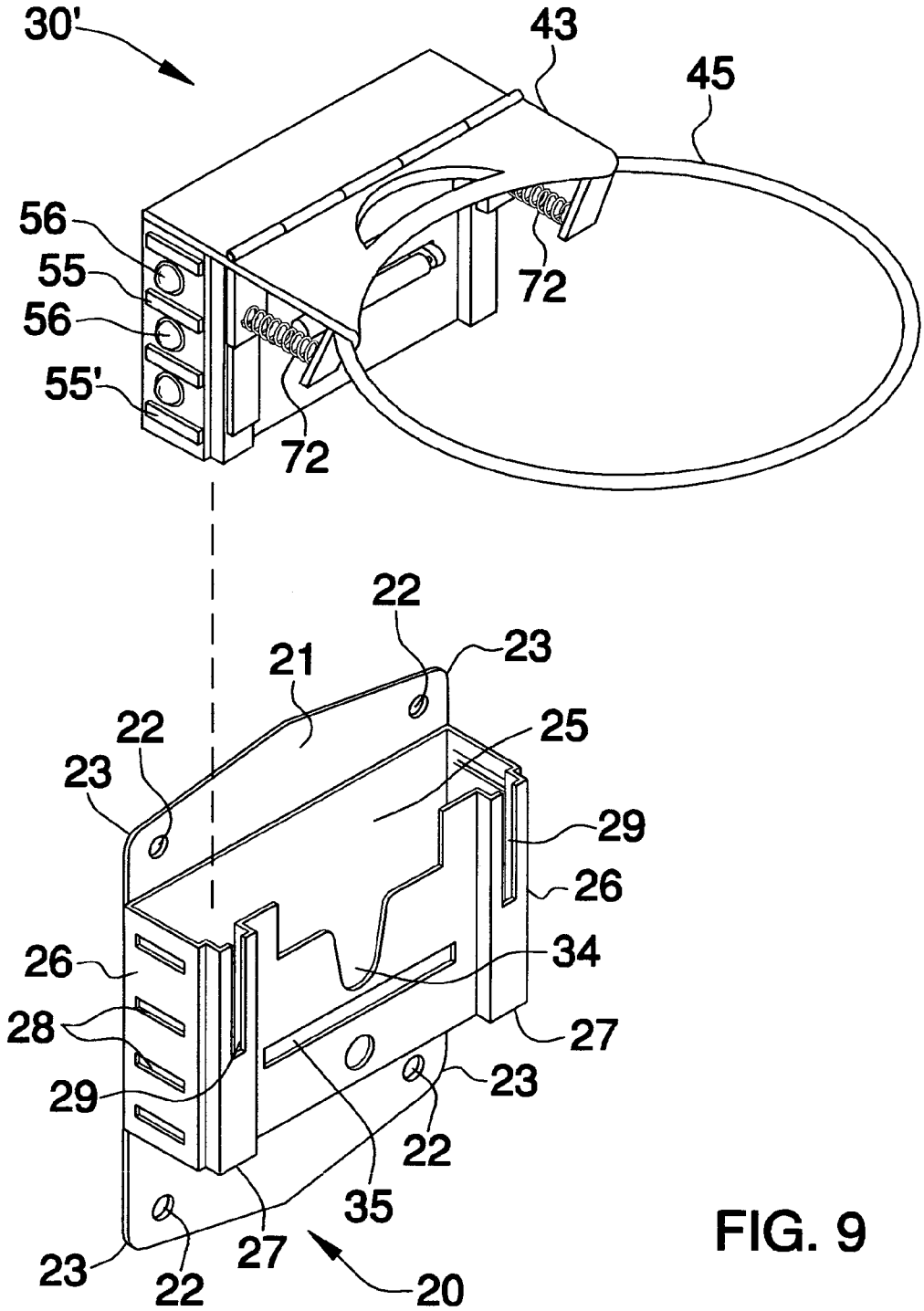
FIG. 9 is a perspective view of the housing section receiving the anchor section, the opposing mechanism, and the rim section.

Referring to FIGS. 2, 7 and 9, the anchor section 30 preferably further includes a pair of spaced flange portions 38 protruding forwardly from one of the walls 31 and equidistantly spaced from the axis. A cover plate 33 may be positioned over an open top end 34 of the anchor section 30 and pivotally connected to the rim section 40 respectively. Such a cover plate 33 prevents dirt, leaves and other debris from entering the anchor section 30 and affecting the performance of the locking mechanism 50 (described herein below).

Referring to FIG. 2, the rim section 40 preferably includes a mounting bracket 41 having a rear wall 42 engageable with the opposing mechanism 60 and further having a top wall 43 extending forwardly therefrom. The top wall 43 has a plurality of integrally positioned finger portions 44 extending downwardly and rearwardly therefrom and at an angle offset from the axis. The rim section 40 preferably further includes a substantially annular rim 45 rigidly secured to the mounting bracket 41 and engaged with the finger portions 44 wherein the rim 45 is positioned forwardly of the mounting bracket rear wall 42.

Figure 4:
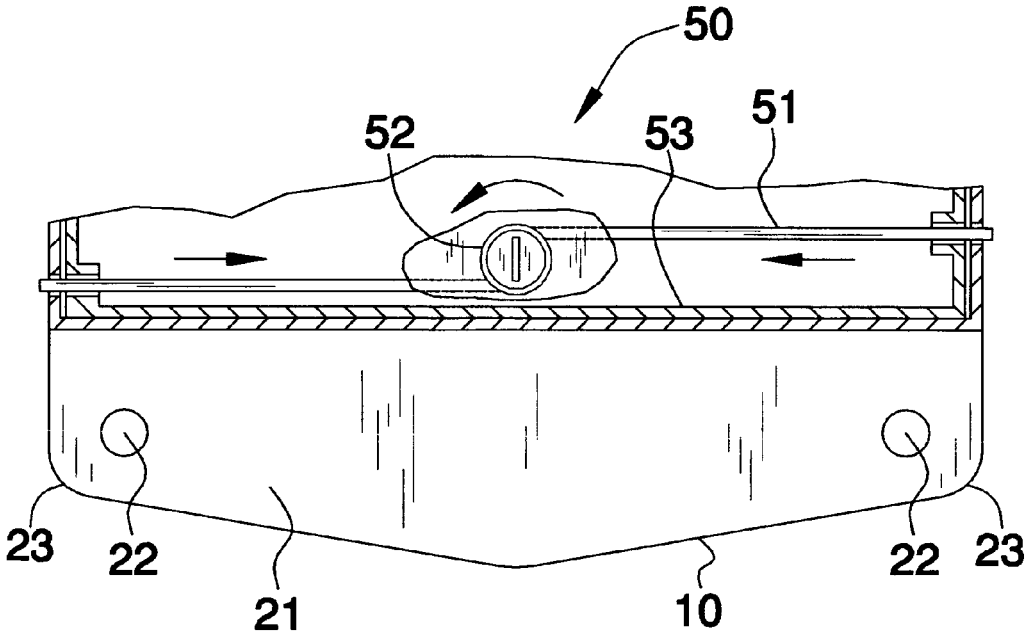
FIG. 4 is an enlarged front elevational view of the locking mechanism.
Figure 5:
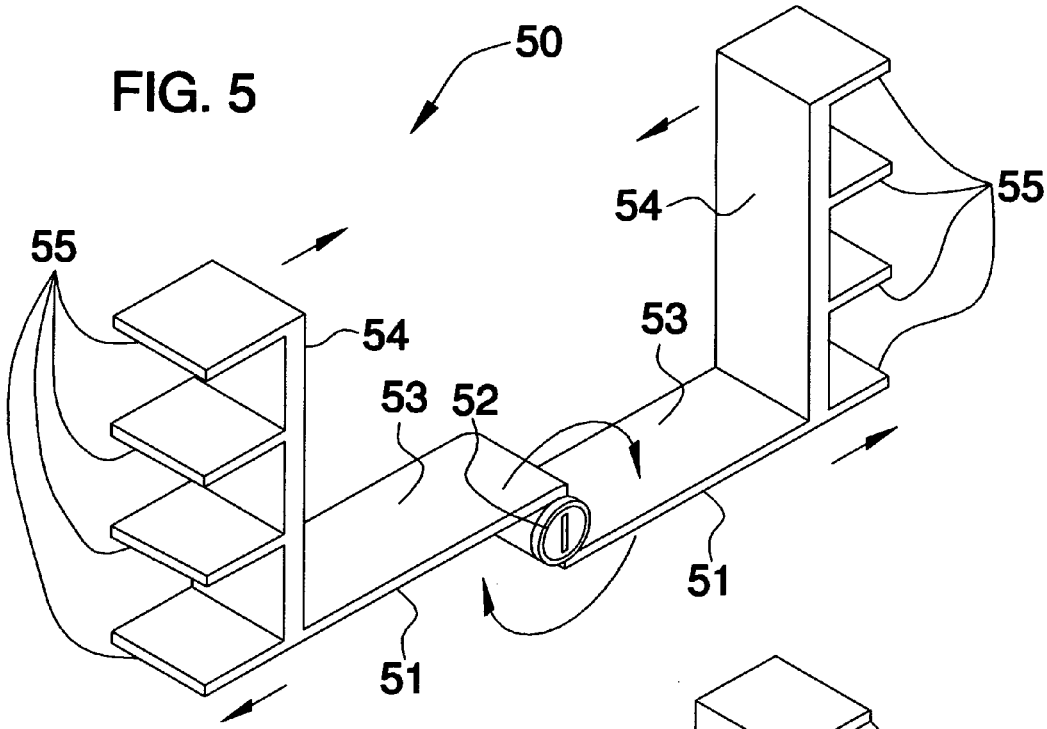
FIG. 5 is an enlarged cross-sectional view of the locking mechanism.

Referring to FIGS. 4 and 5, the locking mechanism 50 preferably includes a plurality of levers 51 and a key lock 52 operably connected thereto. The levers 51 are selectively positionable between lateral and medial positions when a player inserts a key into the lock 52 and rotates the lock 52 along counter clockwise and clockwise positions respectively. The levers 51 include a lower wall 53 adaptable between offset and linear positions corresponding to the medial and lateral positions respectively. The levers 51 preferably further include a plurality of vertically oriented sidewalls 54 each provided with a plurality of stacked appendages 55 extending laterally therefrom. When the lock 52 is rotated, the appendages 55 engage the slots 28 of the housing 20 so that the anchor section 30 remains firmly in place. Advantageously, this ensures that only authorized persons having a key install or remove the assembly 10. Thus, a school, municipality or private homeowner could all control when the basketball hoop is available for use. This prevents unauthorized use during nights and weekends when no supervision is available and mischief is likely to occur.

Figure 5A:
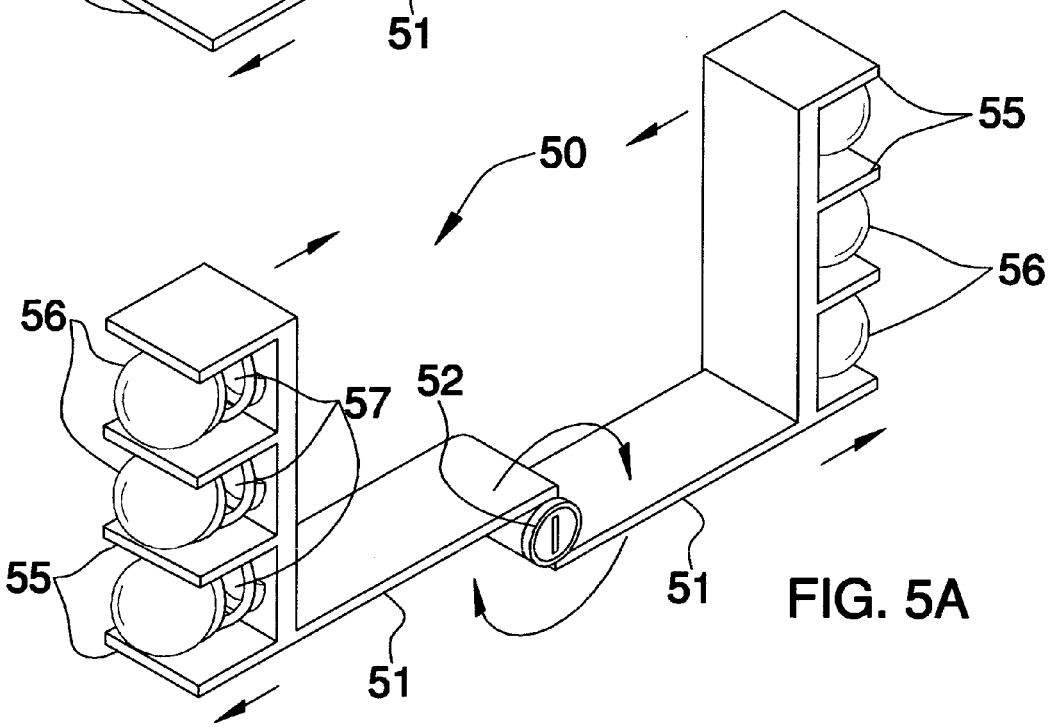
FIG. 5A is an enlarged cross-sectional view of the locking mechanism showing the plurality of ball bearings and spring members operably attached thereto.

Referring to FIG. 5A, the locking mechanism 50 preferably further includes a plurality of ball bearings 56 and a plurality of spring members 57 operably attached thereto and to the lever sidewalls wherein the bearings 56 are juxtaposed between the appendages 55 respectively. The levers 51 are removably positioned into the anchor section 30 wherein the appendages 55 become interlocked with the slots 32 of the anchor section 30, as best shown in FIG. 2. The levers 51 are removable from the anchor section 30 when the player adapts the levers 51 to the medial position and disengages the appendages 55 from the slots 32 respectively, as shown in FIGS. 2, 8 and 9. The spring members 57 assist in maintaining the bearings 56 and appendages 55 firmly in place so that as the rim is used over time, it does not become "sloppy" or loose and there is very little play in the fit of the anchor section 30 when mated with the housing 20.

Referring to FIG. 9, the housing section 20 preferably further has a plurality of horizontal slots 28 formed therein for selectively receiving the appendages 55 during operating conditions and a plurality of vertical slots 29 for selectively receiving the flange portions 32 of the anchor section 30 and assisting to maintain the anchor section 30 at a substantially stable position. A central slot 35 is formed therein.

Referring to FIG. 8, the anchor section 30 preferably further includes a horizontally disposed elongated bar 36 protruding forwardly therefrom and including a control switch 37 operably connected thereto wherein the bar 36 is selectively adaptable between retracted and extended positions for disengaging and engaging the central slot 35. The rim section 40 may be provided with a cut out portion 46 sized and shaped for assisting a player to maintain an elevated position while engaging the switch 37 and removing the anchor section 30 from the housing section 20.

Referring to FIG. 2, the opposing mechanism 60 preferably includes a plurality of spring members 71, 72. One of the spring members 71 has opposed end portions 62, 63 secured to the anchor section 30 and operably mateable with the rim section rear wall 42. The one spring member 71 is compressible along the horizontal plane when the rim 45 is downwardly pivoted during playing conditions, ensuring that the rim 45 can absorb the shock exerted by the force of a player hanging on the rim 45. This feature also allows the rim 45 to "give" slightly when a basketball comes in contact therewith, affording players with a soft shooting touch a better chance of scoring a goal. Players who throw up "bricks" or hard shots are unlikely to be so rewarded.

Figure 3:
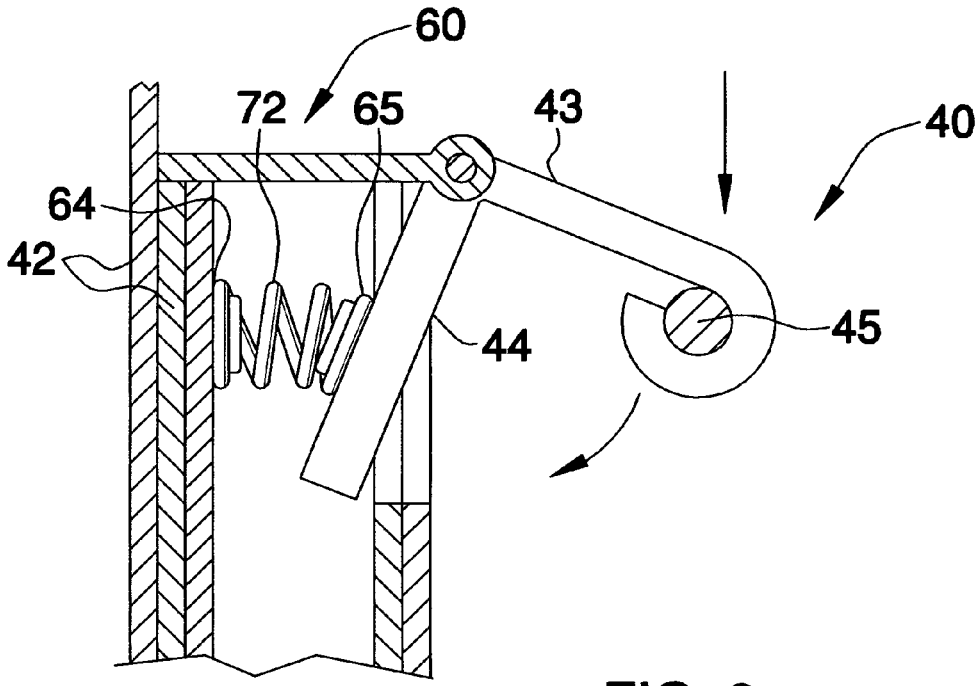
FIG. 3 is an enlarged cross-sectional view of the opposing mechanism shown in FIG. 2 illustrating the rim being downwardly pivoted, taken along line 3—3.
Figure 6:
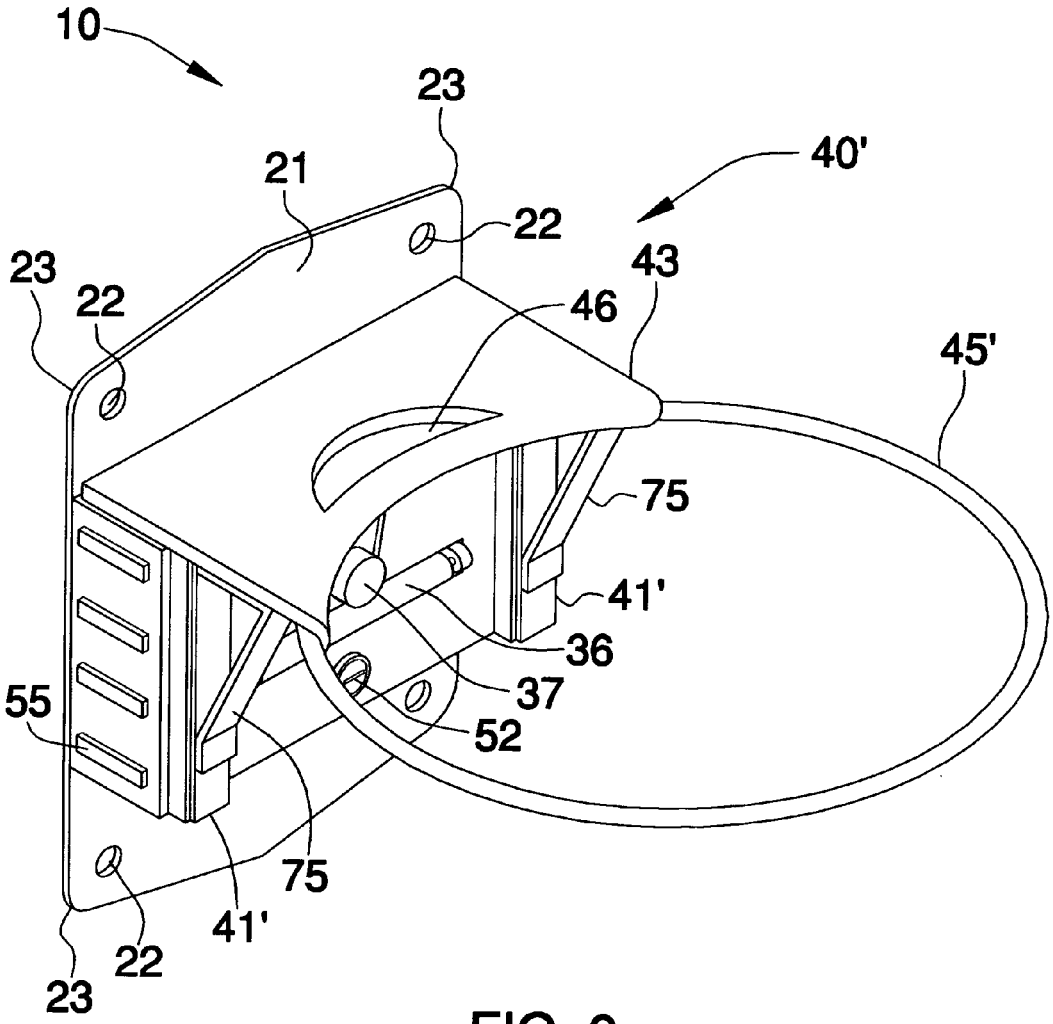
FIG. 6 is a perspective view of an alternate embodiment of the present invention showing a plurality of rigid arms secured to the mounting bracket.

Referring to FIG. 3, other ones of the spring members 72 have opposed end portions 64, 65 secured to the mounting bracket rear wall 42 and the finger portions 44 respectively and cooperate with the one spring member 71 for resisting a downward movement of the rim 45. In an alternate embodiment, a plurality of rigid arms 75 are secured to the mounting bracket 41' and positioned adjacent the rim 45' for resisting external forces acting on the rim section 40' during playing conditions, as best shown in FIGS. 6 and 8. Such rigid arms 75 allow no flexibility in the rim, resulting in what players call "tight' rims which are unlikely to allow a goal on a shot slightly off target that deflects off the rim 45.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A basketball rim assembly for allowing a player to removably attach a rim to an existing backboard, said assembly comprising:

a housing section securely mounted to a selected portion of the backboard and having a centrally disposed vertical axis;

an anchor section removably positionable into said housing;

a rim section connected to said anchor section and extending outwardly therefrom along a substantially horizontal plane;

means for locking said anchor section with said housing section after said anchor section has been positioned therein; and means for resiliently opposing downwardly forces exerted on said rim section such that a player can offset said rim section from the horizontal plane without permanently detaching said rim section from said anchor section wherein said anchor section comprises: a plurality of walls integrally attached for defining a generally rectangular shape corresponding to a shape of the cavity, opposing ones of said walls being provided with a plurality of slots extending parallel to each other, selected ones of the slots being oppositely spaced apart and positioned along a level plane; a pair of spaced flange portions protruding forwardly from one said walls and being equidistantly spaced from the axis; and a cover plate positioned over an open top end of said anchor section and pivotally connected to said rim section respectively.

2. The assembly of claim 1, wherein said housing section comprises:

a substantially planar rear wall provided with a plurality of holes formed at opposed corners thereof for receiving a plurality of fastening members therethrough respectively; and a protruding support compartment integral with said rear wall, said support compartment having a plurality of sidewalls and a front wall integrally connected for defining a cavity therebetween.

3. The assembly of claim 1, wherein said rim section comprises:

a mounting bracket having a rear wall engageable with said opposing means and further having a top wall extending forwardly therefrom, said top wall having a plurality of integrally positioned finger portions extending downwardly and rearwardly therefrom and at an angle offset from the axis;

a substantially annular rim rigidly secured to said mounting bracket and engaged with said finger portions wherein said rim is position forwardly of said mounting bracket rear wall.

4. The assembly of claim 1, wherein said locking means comprises:

a plurality of levers and a key lock operably connected thereto, said levers being selectively positionable between lateral and medial positions when a player inserts a key into said lock and rotates said lock along counter clockwise and clockwise positions respectively, said levers including a lower wall adaptable between offset and linear positions corresponding to the medial and lateral positions respectively, said levers further including a plurality of vertically oriented sidewalls each provided with a plurality of stacked appendages extending laterally therefrom; and a plurality of ball bearings and a plurality of spring members operably attached thereto and to said lever sidewalls wherein said bearings are juxtaposed between said appendages respectively, said levers being removably positioned into said anchor section wherein said appendages become interlocked with the slots of said anchor section, said levers being removable from said anchor section when the player adapts said levers to the medial position and disengages said appendages from the slots respectively;

said housing section further having a plurality of horizontal slots formed therein for selectively receiving said appendages during operating conditions, said housing section further having a plurality of vertical slots for selectively receiving said flange portions of said anchor section and assisting to maintain said anchor section at a substantially stable position, said housing section further having a central slot formed therein;

said anchor section further including a horizontally disposed elongated bar protruding forwardly therefrom and including a control switch operably connected thereto wherein said bar is selectively adaptable between retracted and extended positions for disengaging and engaging the central slot;

said rim section being provided with a cut out portion sized and shaped for assisting a player to maintain an elevated position while engaging said switch and removing said anchor section from said housing section.

5. The assembly of claim 3, wherein said opposing means comprises:

a plurality of spring members, one said spring members having opposed end portions secured to said anchor section and operably mateable with said rim section rear wall, said one spring member being compressible along the horizontal plane when said rim is downwardly pivoted during playing conditions; and other ones of said spring members having opposed end portions secured to said mounting bracket rear wall and said finger portions respectively, said other spring members cooperating with said one spring member for resisting a downward movement of said rim.

6. The assembly of claim 3, wherein said opposing means comprises:

a plurality of rigid arms secured to said mounting bracket and positioned adjacent said rim for resisting external forces acting on said rim section during playing conditions.

7. A basketball rim assembly for allowing a player to removably attach a rim to an existing backboard, said assembly comprising:

a housing section securely mounted to a selected portion of the backboard and having a centrally disposed vertical axis;

an anchor section removably positionable into said housing;

a rim section pivotally connected to said anchor section and extending outwardly therefrom along a substantially horizontal plane;

means for locking said anchor section with said housing section after said anchor section has been positioned therein; and means for resiliently opposing downwardly forces exerted on said rim section such that a player can offset said rim section from the horizontal plane without permanently detaching said rim section from said anchor section wherein said anchor section comprises: a plurality of walls integrally attached for defining a generally rectangular shape corresponding to a shape of the cavity, opposing ones of said walls being provided with a plurality of slots extending parallel to each other, selected ones of the slots being oppositely spaced apart and positioned along a level plane; a pair of spaced flange portions protruding forwardly from one said walls and being equidistantly spaced from the axis; and a cover plate positioned over an open top end of said anchor section and pivotally connected to said rim section respectively.

8. The assembly of claim 7, wherein said housing section comprises:

a substantially planar rear wall provided with a plurality of holes formed at opposed corners thereof for receiving a plurality of fastening members therethrough respectively; and a protruding support compartment integral with said rear wall, said support compartment having a plurality of sidewalls and a front wall integrally connected for defining a cavity therebetween.

9. The assembly of claim 7, wherein said rim section comprises:

a mounting bracket having a rear wall engageable with said opposing means and further having a top wall extending forwardly therefrom, said top wall having a plurality of integrally positioned finger portions extending downwardly and rearwardly therefrom and at an angle offset from the axis;

a substantially annular rim rigidly secured to said mounting bracket and engaged with said finger portions wherein said rim is position forwardly of said mounting bracket rear wall.

10. The assembly of claim 7, wherein said locking means comprises:

a plurality of levers and a key lock operably connected thereto, said levers being selectively positionable between lateral and medial positions when a player inserts a key into said lock and rotates said lock along counter clockwise and clockwise positions respectively, said levers including a lower wall adaptable between offset and linear positions corresponding to the medial and lateral positions respectively, said levers further including a plurality of vertically oriented sidewalls each provided with a plurality of stacked appendages extending laterally therefrom; and a plurality of ball bearings and a plurality of spring members operably attached thereto and to said lever sidewalls wherein said bearings are juxtaposed between said appendages respectively, said levers being removably positioned into said anchor section wherein said appendages become interlocked with the slots of said anchor section, said levers being removable from said anchor section when the player adapts said levers to the medial position and disengages said appendages from the slots respectively;

said housing section further having a plurality of horizontal slots formed therein for selectively receiving said appendages during operating conditions, said housing section further having a plurality of vertical slots for selectively receiving said flange portions of said anchor section and assisting to maintain said anchor section at a substantially stable position, said housing section further having a central slot formed therein;

said anchor section further including a horizontally disposed elongated bar protruding forwardly therefrom and including a control switch operably connected thereto wherein said bar is selectively adaptable between retracted and extended positions for disengaging and engaging the central slot;

said rim section being provided with a cut out portion sized and shaped for assisting a player to maintain an elevated position while engaging said switch and removing said anchor section from said housing section.

11. The assembly of claim 9, wherein said opposing means comprises:

a plurality of spring members, one said spring members having opposed end portions secured to said anchor section and operably mateable with said rim section rear wall, said one spring member being compressible along the horizontal plane when said rim is downwardly pivoted during playing conditions; and other ones of said spring members having opposed end portions secured to said mounting bracket rear wall and said finger portions respectively, said other spring members cooperating with said one spring member for resisting a downward movement of said rim.

12. The assembly of claim 9, wherein said opposing means comprises:

a plurality of rigid arms secured to said mounting bracket and positioned adjacent said rim for resisting external forces acting on said rim section during playing conditions.

* * * * *